US007047878B2

(12) United States Patent
Gelbart

(10) Patent No.: US 7,047,878 B2
(45) Date of Patent: May 23, 2006

(54) FLEXOGRAPHIC PRINTING ON CONTAINERS

(75) Inventor: Daniel Gelbart, Vancouver (CA)

(73) Assignee: Kodak Graphic Communications Canada Company, Burnaby (CA)

( * ) Notice: Subject to any disclaimer, the term of this patent is extended or adjusted under 35 U.S.C. 154(b) by 0 days.

(21) Appl. No.: 11/030,143

(22) Filed: Jan. 7, 2005

(65) Prior Publication Data

US 2005/0115431 A1 Jun. 2, 2005

Related U.S. Application Data

(62) Division of application No. 10/689,087, filed on Oct. 21, 2003, now Pat. No. 6,907,823.

(51) Int. Cl.
*B41F 17/08* (2006.01)

(52) U.S. Cl. ..... 101/38.1; 101/37; 101/40.1

(58) Field of Classification Search ..... 101/35, 101/36, 37, 38.1, 39, 40, 40.1
See application file for complete search history.

(56) References Cited

U.S. PATENT DOCUMENTS

| | | | | |
|---|---|---|---|---|
| 3,405,633 | A | | 10/1968 | Price, Jr. et al. |
| 3,564,998 | A | | 2/1971 | Johnson et al. |
| 3,661,282 | A | | 5/1972 | Buhayar et al. |
| 4,456,422 | A | | 6/1984 | Swayze |
| 4,480,540 | A | | 11/1984 | Lock et al. |
| 4,889,050 | A | | 12/1989 | Meador |
| 5,181,471 | A | * | 1/1993 | Sillars ..... 101/483 |
| 5,193,456 | A | | 3/1993 | Wolfe et al. |
| 5,333,720 | A | | 8/1994 | Zwigart et al. |
| 5,337,659 | A | * | 8/1994 | Whelan ..... 101/40 |
| 5,467,864 | A | | 11/1995 | McCoy et al. |
| 5,730,048 | A | | 3/1998 | Averill et al. |
| 5,865,114 | A | | 2/1999 | Averill et al. |
| 5,970,865 | A | | 10/1999 | Horth et al. |
| 6,026,743 | A | | 2/2000 | Kloti |

FOREIGN PATENT DOCUMENTS

WO WO 94/19192 A1 9/1994

* cited by examiner

*Primary Examiner*—Ren Yan
(74) *Attorney, Agent, or Firm*—Oyen Wiggs Green and Mutala

(57) ABSTRACT

A flexographic press of conventional design is used to print on a container, with the container to be printed upon replacing the web and the impression roll of the conventional press. In order to maintain the registration between the print stations, the container is placed into a carrier and stays registered to the carrier until all colors are printed. The carrier is moved between the different print stations and is registered to each print station independently. All print stations are set up to print in exactly the same place relative to the carrier, thus registration is achieved.

33 Claims, 7 Drawing Sheets

FLEXOGRAPHIC PRINTING ON CONTAINERS

REFERENCE TO RELATED APPLICATION

This is a division of application Ser. No. 10/689,087 filed on 21 Oct. 2003 now U.S. Pat. No. 6,907,823 entitled "Flexographic Printing on Containers".

TECHNICAL FIELD

The invention pertains to printing and, more specifically, to an apparatus for directly printing multi-color images on containers such as bottles and cans.

BACKGROUND

When printing multi-color images, accurate registration is required between colors. Since most containers have neither accurate reference features nor stiffness, it is difficult to print multi-color images on them. Such printing normally requires multiple printing units (one for each color). Registration is difficult to maintain when a container is transferred between successive printing units. For this reason, most color images on bottles are done by applying a pre-printed label to the bottle, increasing production costs over direct printing. In some cases, such as when printing drinking cups or unfilled cans, a mandrel may be inserted into the container to achieve stiffness and registration (see for example U.S. Pat. Nos. 5,193,456 and 3,661,282). In the great majority of cases, the insertion of a mandrel to fill the container and allow registration is not possible, as inserting a mandrel requires that the container have an opening at least as large as its largest cross-section.

Flexographic printing is an ideal process for printing on thin-walled containers, as flexographic printing requires almost no pressure. Accordingly, a method and apparatus for flexographic printing on containers is highly desirable. A typical flexographic press comprises an ink supply (also referred to as an "ink fountain"), and a metering roll in contact with the ink supply. The metering roll transfers an accurately-metered amount of ink to the plate (which is mounted on a plate cylinder). The flexographic press prints on a material to be printed, usually in the form of a web, and includes an impression cylinder used to support the web. The most common form of metering roll is known as an anilox roll. An anilox roll is a hard cylinder engraved with a continuous pattern of small pits. Excess ink is removed by a doctor blade or a reverse roll, leaving ink only in the recessed areas. The flexographic plate operates in a manner similar to the common rubber stamp: the elevated areas are inked and this ink is transferred to the web. The plate is usually mounted on a thin layer of cushioning foam.

There is a need for practical systems for printing monochrome and color images directly onto containers, such as plastic and glass bottles, cans, cups, jars and the like. There is a particular need for such systems which can maintain registration between images applied by different printing units in a manner compatible with present flexographic press design.

SUMMARY OF INVENTION

This invention provides apparatus for printing on containers which are not cylindrical. The apparatus includes a number of flexographic printing stations. The container to be printed replaces the web and the impression roll. To maintain registration between the print stations, the container is placed into a carrier. Registration with the carrier is maintained until all of the colors are printed. The carrier is moved between the different print stations and is registered to each print station independently. All print stations are set up to print in exactly the same place relative to the carrier, thereby ensuring registration. Because of the slight shape variations between containers (even among ones from the same batch) a thicker and softer cushioning foam is used. In order to automate the process, a number of such carriers can be mounted on a conveyor belt, which moves the carriers from one print station to the next.

Registration may be performed while both the conveyor belt and the press are in operation, thus eliminating the need to stop and register. Performing the registration while in motion greatly increases throughput. The carriers are designed such that containers can be clamped and released (after printing is completed) while the carriers are in motion. This allows a high throughput continuous process, which is desirable for printing on high volume items, such as cans and bottles. The apparatus can be made to print on any shape of container that a regular label can be used on, such as, but not limited to, cylindrical, oval, conical and conical with oval cross section.

The invention and its objectives will become more clear by studying the preferred implementation in conjunction with the drawings.

BRIEF DESCRIPTION OF DRAWINGS

In drawings which illustrate non-limiting embodiments of the invention.

DESCRIPTION

Figure 1:
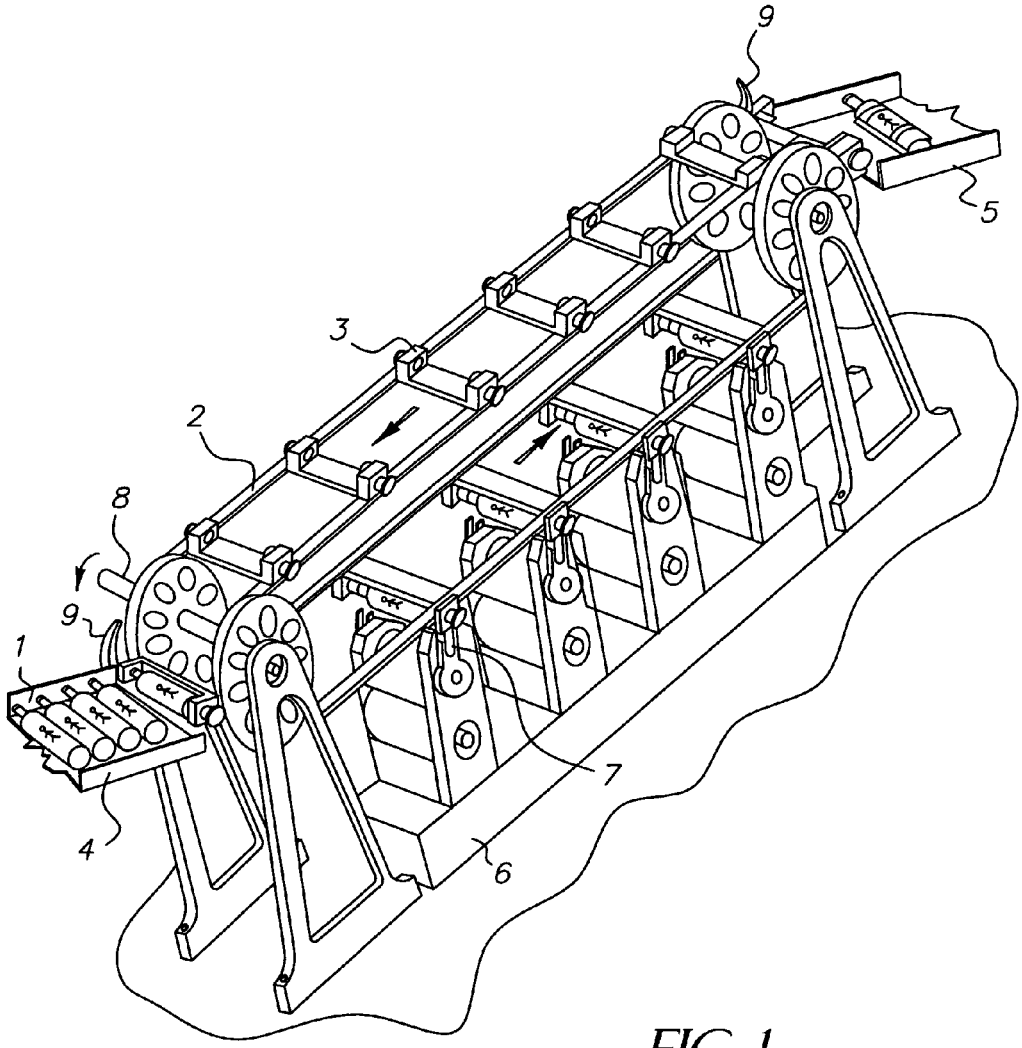
FIG. 1 is an isometric view of a printing system according to a particular embodiment of the invention.

Referring to FIG. 1, a flexographic printing press 6 comprises a plurality of printing units. Each unit prints one color. Typically, the number of printing units on such a press ranges from 4 to 10 units. An endless conveyor belt 2 moves carriers 3 past the printing units. The containers 1 (bottles in some preferred embodiments) are supplied by an infeed tray 4 and are unloaded to an output tray 5. The conveyor belt 2 is powered by a shaft 8, which may be driven by a separate motor (not shown) or may be connected mechanically to the motor of press 6. If a separate motor is used, it must be synchronized to the speed of press 6 using the well-known principles of servo systems (also known as "shaftless" systems in printing presses).

At both the infeed and unload positions of conveyor belt 2, means 9 are provided to open carrier 3 in order to accept a container 1 (at infeed tray 4) and release the container 1 (at output tray 5). The details of mechanism 9 are discussed later with reference to FIG. 3 and FIG. 4. Each printing unit also has a registration means 7 to register carrier 3 to the printing unit, and thereby to the printing plate mounted on the printing cylinder of the printing unit as the carrier 3 passes through it. The cylinder and plate are described below in more detail with reference to FIGS. 5 and 7.

Figure 2:
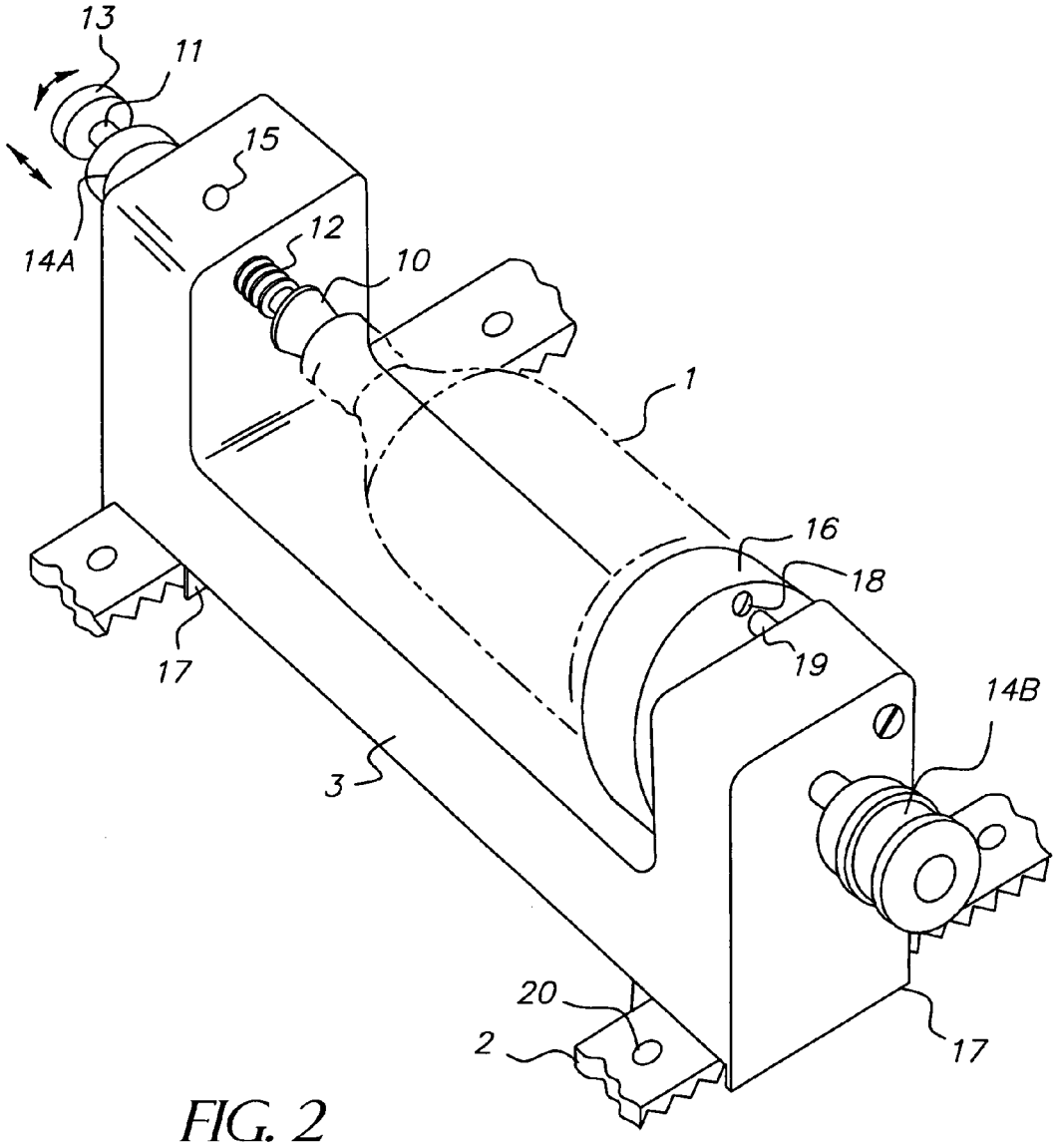
FIG. 2 is an isometric view of the carrier of the FIG. 1 system.

FIG. 2 shows a preferred embodiment of carrier 3. Carrier 3 is loosely attached to conveyor belt 2 via guides 17. Guides 17 allow some slippage between carrier 3 and conveyor belt 2, in order for carrier 3 to be able to align itself with each print unit. A stop 20 limits the range over which carrier 3 can move relative to belt 2. An alternative embodiment uses an elastic attachment, for example a spring, to attach carrier 3 to conveyor belt 2. Container 1 is held from two of its ends, similar to a workpiece held in a lathe. At one end, a chuck 16 is shaped to fit the container; at the other end, a tapered plug 10 fits into the opening of the container and is held there by the force of spring 12. Shaft 11 can be retracted by pulling on ball bearing 13. When shaft 11 is retracted, container 1 can be inserted and removed. As described further below, ball bearings 14A and 14B are used to align carrier 3 to the printing unit. In this description, reference numerals ending in the letters "A" and "B" refer to similar components located on the left and right hand sides of press 6, in the orientation shown in FIG. 1.

Figure 3:
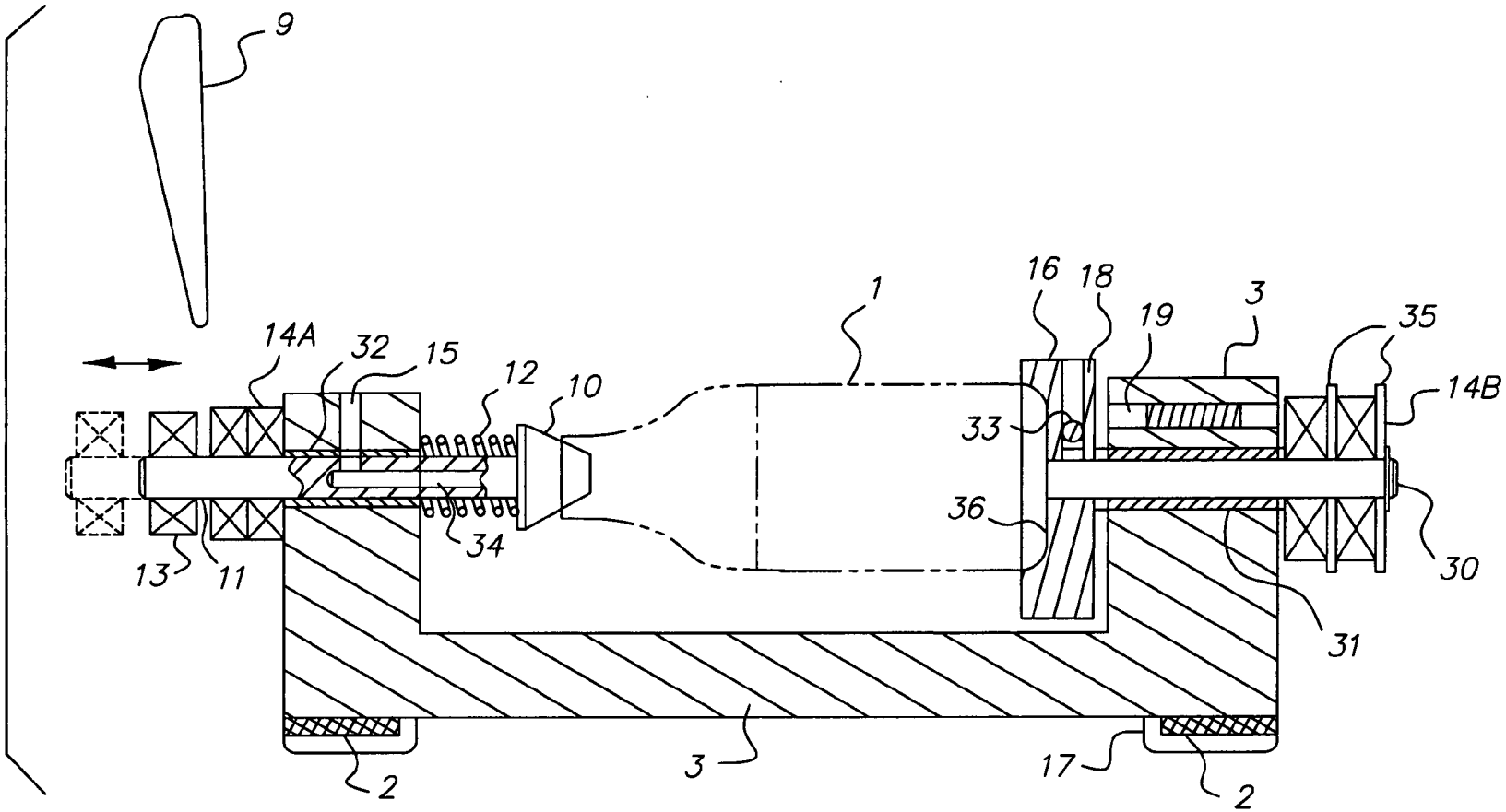
FIG. 3 is a cross section of the FIG. 2 carrier.

In some cases, for example when printing on thin-walled containers, it is desirable to pressurize the inside of the container via an air hole 15. Referring now to FIGS. 2 and 3, it can be seen that air hole 15 is connected to a hole in shaft 11 and plug 10. This allows air to be fed into container 1 for the short duration which container 1 is in contact with the printing unit.

Figure 4:
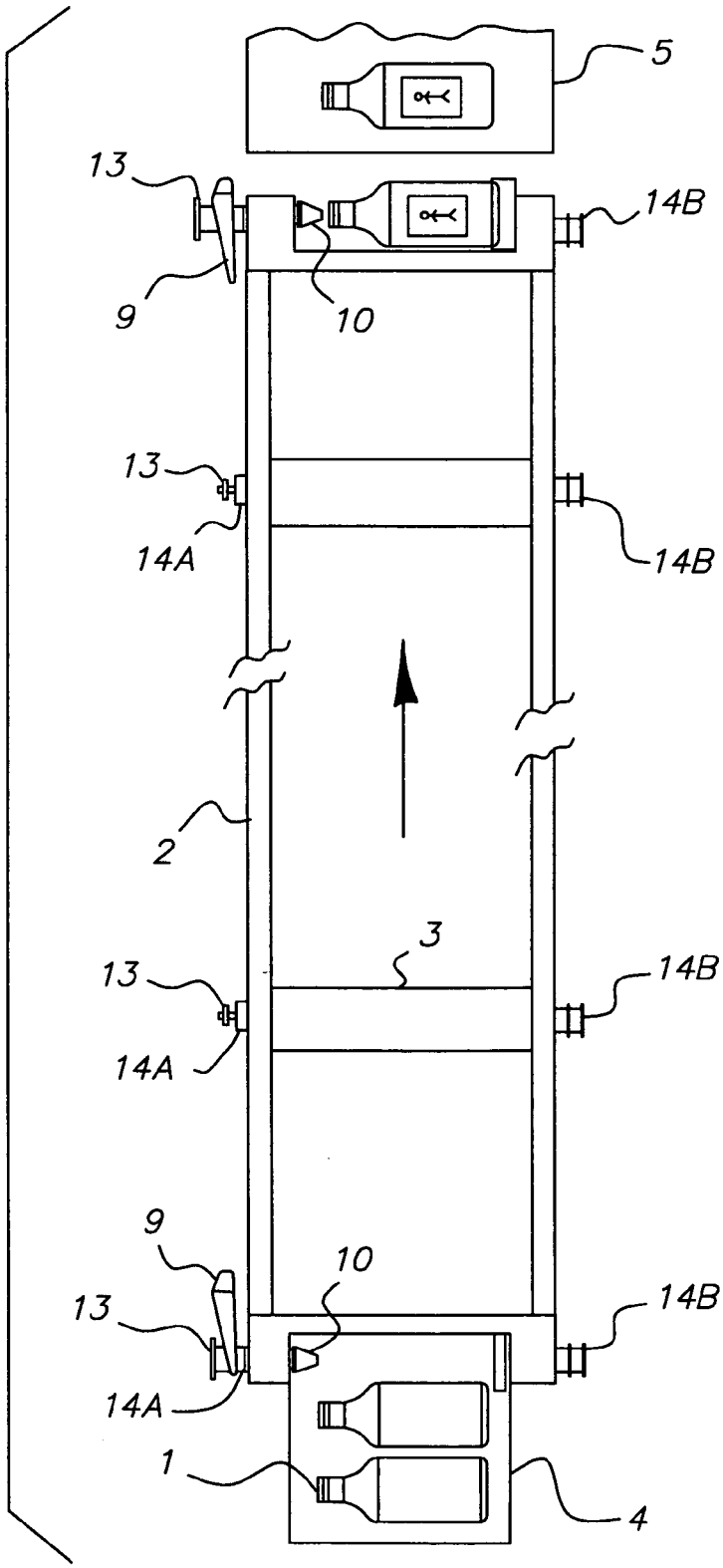
FIG. 4 is a top view of the conveyor belt system, showing loading and unloading of containers from the carriers.

The mechanism to retract shaft 11 can be as simple as a wedge 9, which is placed in the path of carrier 3. As bearing 13 rolls against the edge of wedge 9, shaft 11 is pulled out. FIG. 4 shows the placement of such wedges 9 at both the infeed position (at or near infeed tray 4) and the unload position (at or near output tray 5) of conveyor belt 2.

Returning to FIGS. 2 and 3, different sizes and shapes of chuck 16 and plug 10 may be provided for each size and shape of container. When printing on cans, the shape of plug 10 may be similar to chuck 16. Means for removing chuck 16 are shown schematically as a setscrew 33. It has been found that the pressure of spring 12 is sufficient to keep container 1 in place during printing if the inside of chuck 16 is coated with a high friction material 36 such as silicone rubber or polyurethane rubber.

Shafts 11 and 30 can rotate freely in bearings 32 and 31. In some applications, for example when printing on rectangular or oval containers, container 1 should be prevented from rotating during printing. In some other applications, such as printing all around cylindrical containers, container 1 may be allowed to rotate, but should return to a known orientation. This is accomplished via detent 18 and spring loaded pin 19. When printing covers the full circumference of container 1, chuck 16 will return to the detent position.

If printing is not required to cover the full circumference of container 1, the printing plate may be continued as a narrow non-inked strip in order to complete the rotation of container 1. More details on this subject are provided later in this disclosure. It should be noted that registration is required in both the circumferential direction (achieved by detent 18) and in the axial direction. Therefore, shaft 30 should be free from any axial play and the shoulders 35 of bearing 14B should fit the mating part (item 7B in FIG. 5) accurately. In one preferred embodiment, belt 2 is a timing belt, bearings 13 and 14 are shielded ball bearings, bearings 31 and 32 are sintered bronze bushings, and carrier body 3 is made of aluminum.

Figure 5:
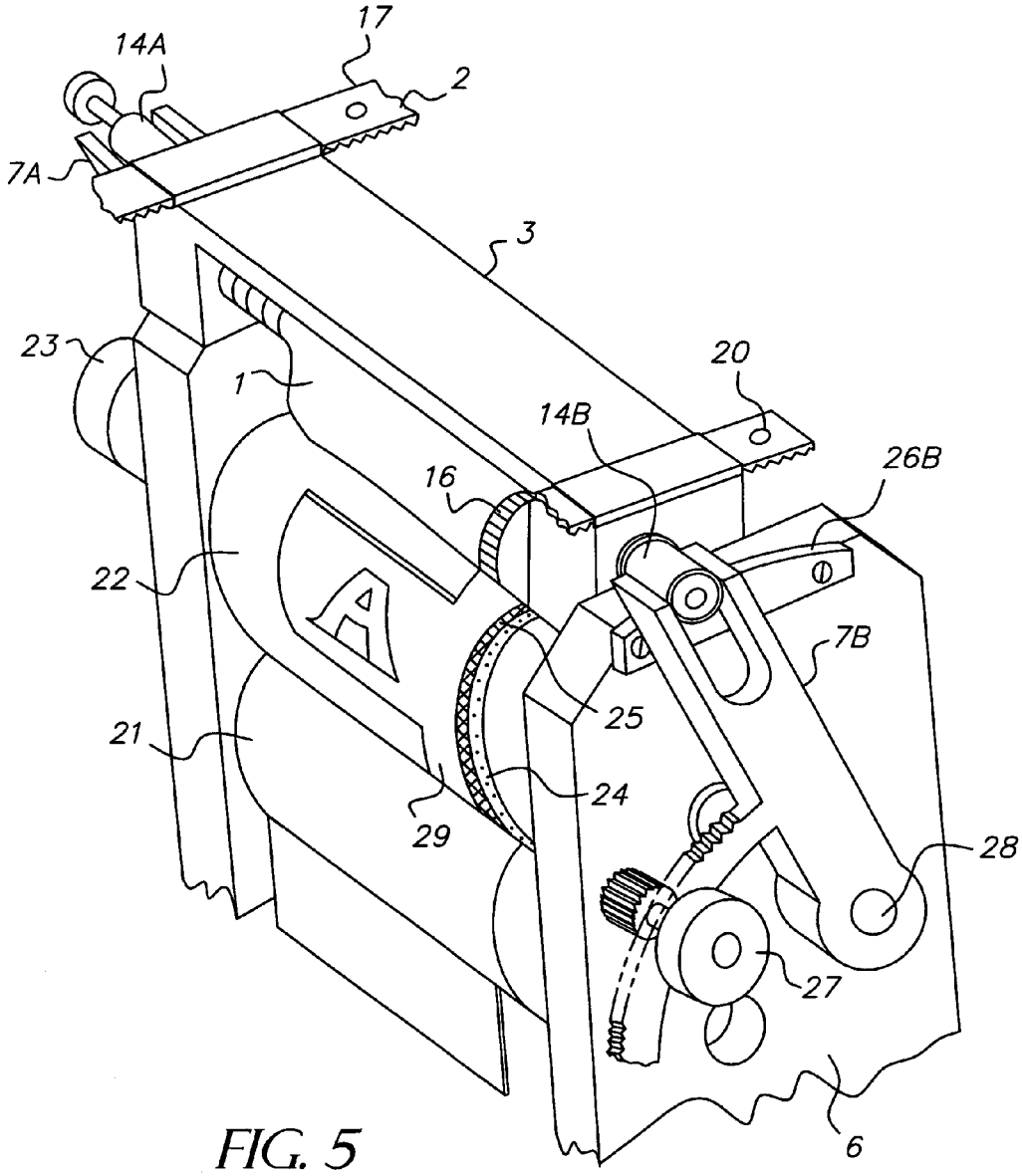
FIG. 5 is an isometric view of the mechanism for registering the carrier to a printing unit.
Figure 6A:
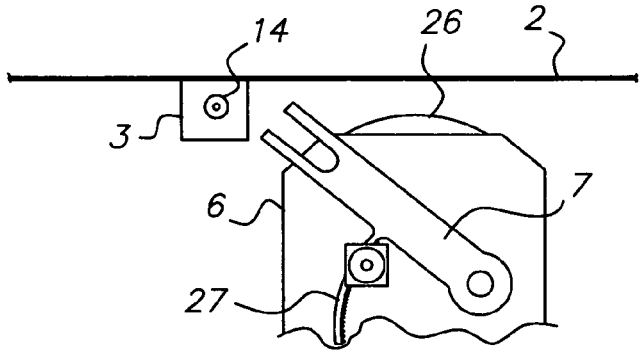
FIGS. 6*a*, 6*b*, 6*c* and 6*d* show schematically the sequence of a carrier passing through a printing unit.
Figure 6B:
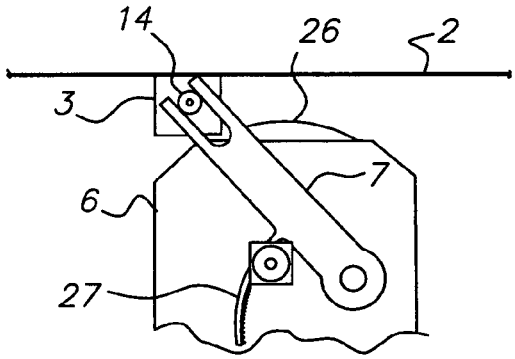
Figure 6C:
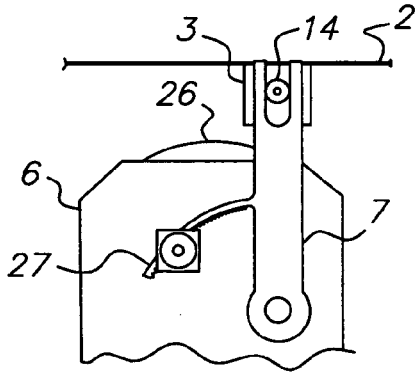
Figure 6D:
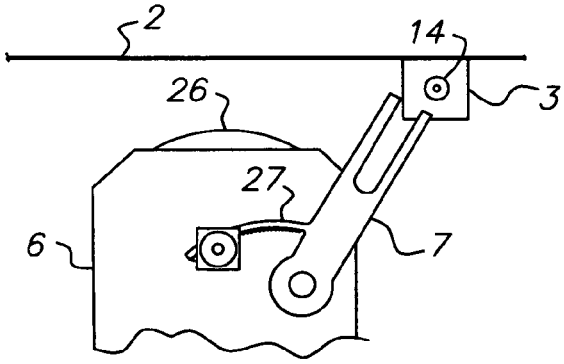

FIG. 5 depicts the mechanism for registering carrier 3 to a printing unit. The FIG. 5 mechanism has four functions:

1. locating carrier 3 axially relative to printing plate 25. In this disclosure, the axial direction is the direction of the axis of container 1 and of printing cylinder 22;
2. locating the axis of container 1 in an orientation that is parallel to the axis of printing cylinder 22;
3. bringing container 1 into contact with printing plate 25 at the correct circumferential point and ensuring contact is sufficient for a complete rotation (for round containers); and
4. locating container 1 in the vertical direction to achieve the correct impression pressure via the correct compression of the foam backing 24 of printing plate 25.

As conveyor belt 2 brings carrier 3 closer to printing press 6, arms 7A and 7B engage bearings 14A and 14B. It is desirable to make arm 7B with a tapered tip, i.e. the thickness of the arm in the axial direction at the tip is less than the thickness at the position of normal engagement during printing. This helps with guiding arm 7B between the shoulders 35 of bearing 14B (see FIG. 3). The sequence of the engagement between a bearing 14 and its corresponding arm 7 is shown in FIG. 6*a* to 6*d*.

As shown in FIG. 5, arms 7A and 7B are coupled by a sturdy shaft 28 which runs parallel to the axis of the plate cylinder 22. Arms 7A and 7B therefore force the axis of container 1 to be parallel to the axis of plate cylinder 22. The elevation of carrier 3 during printing, and therefore the compression of foam layer 24 under plate 25, is determined by guide plates 26A and 26B (see also FIG. 7 for greater clarity). Guide plates 26 should be adjusted for an average compression of about 0.5 mm in foam layer 24. Foam layer 24 is made of dense closed cell foam, about 2–4 mm in thickness. The standard foam tape used for mounting flexographic printing plates is too thin for this purpose (but can be used to attach plate 25 to foam layer 24). It has been found that, under these conditions, very good dot reproduction 5%–95%) of fine screens (up to 80/cm) may be achieved even with a container run-out of 1 mm. Obviously, the compression of foam layer 24 should be such as to allow contact with container 1 even at the worst run-out to be encountered. Too much compression degrades print quality, too little compression may cause loss of contact. The optimum elevation of guide plate 26 may be found by carefully experimenting during a trial run.

In order to achieve circumferential registration between container 1 and plate 25 and between the image and the index position of container 1, the angular position of plate cylinder 22 is measured by shaft encoder 23 (FIG. 5). At the correct position of cylinder 22, actuators 27 push carrier 3 into contact with plate cylinder 22. In the illustrated embodiment, actuator 27 is a servomotor, coupled to arm 7B by a gear. An alternative coupling is via a timing belt. The details of connecting an output of shaft encoder 23 to the servomotor actuator 27 are not shown or described, as they follow standard procedures of servo systems well known in the art of printing press design. Because actuators 27 may momentarily stop carrier 3 from moving while conveyor belt 2 keeps moving, some relative motion should be possible between carrier 3 and belt 2. In the illustrated embodiment, there is a sliding fit, which may be a friction fit, between them.

Figure 7:
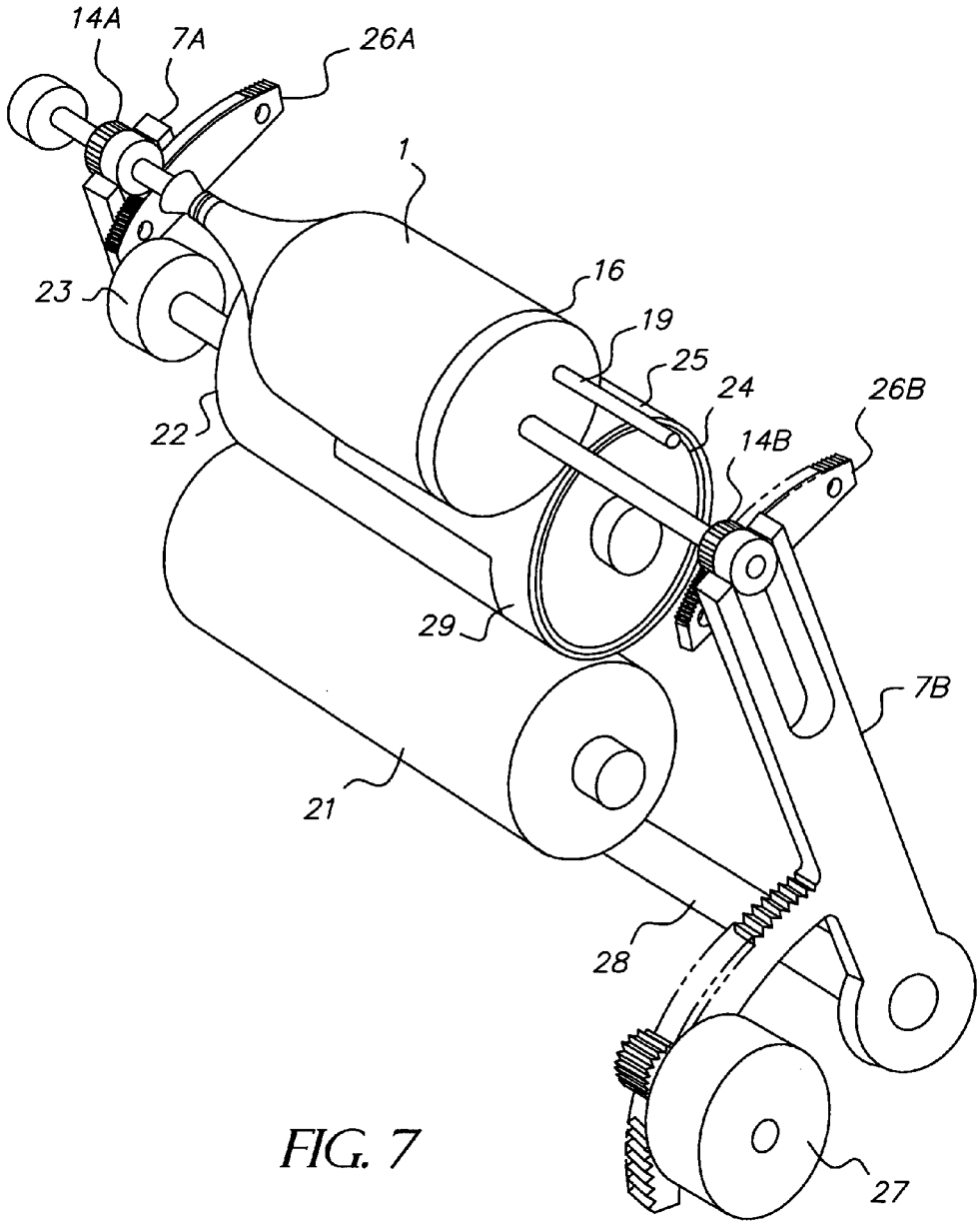
FIG. 7 is an isometric view of printing on an oval container, with the sidewalls of the printing unit removed for clarity.

Bearing 14B is shaped to allow part of the bearing to ride on guide plate 26B, while the other part engages arm 7B (see FIGS. 3 and 7 for more detail). Together bearing 14B and arm 7B provide axial registration between carrier 3 and printing plate 25. An alternative to using bearing 14B for axial registration is to use a vertical guide plate to guide bearing 14B in the axial direction, similar to the guidance provided by plates 26 in the vertical direction. There should be only minimal play (i.e. gap) between arms 7A and 7B and corresponding bearings 14A and 14B, as any play will tend to cause axial mis-registration.

When container 1 touches plate 25, it starts rotating because of friction (overcoming the detent action of detent 18 in FIG. 3). At the same time, arms 7 move carrier 3 and container 1 slowly to the other side of plate cylinder 22 until container 1 stops touching plate 25. By adjusting the speed and amount of travel of arms 7, container 1 will complete one rotation as it travels from one side of plate cylinder 22 to the other. A slight variation (a few %) will not matter, as container 1 will be pulled into the reference position by the action of detent 18. The detent action of carrier 3 is also important when containers are loaded at a specific orientation, in order to avoid printing on the seam or other defects. Containers may be loaded at a random orientation and additional hardware may be used to orient them to a reference position. This is common practice in current label applicators.

Clearly, the motion of arms 7 must be slower than the circumferential velocity of plate cylinder 22, otherwise container 1 will not complete a full rotation during the time that it travels from one side of plate cylinder 22 to the other. In those cases where it is not desired to print the full circumference of container 1, a "dummy" portion 29 of plate 25 is left to complete the rotation. This portion 29 is aligned with chuck 16 and is not inked by anilox roll 21, as its only function is to serve as a friction drive for container 1. Accidental inking, however, is not detrimental. Anilox roll 21 can be made narrower than plate cylinder 22 to avoid inking of strip 29. No further details of press 6 are provided in this description, as the rest is conventional in construction and well known in the art of flexographic printing presses.

FIG. 7 shows printing on an oval container 1. Similar techniques to those shown in FIG. 7 may also be used to print on rectangular containers. For clarity, the side walls of the press are not shown in FIG. 7. For oval or rectangular container shapes, it is preferable to prevent container 1 from rotating by using a firmer pressure of pin 19 against the detent hole in chuck 16. Container 1 is moved into printing position by arm 7 and actuator 27, but from the point that plate 25 touches container 1, actuator 27 should not force container 1 across plate 25. Container 1 should move at a velocity determined by plate cylinder 22. This is required as container 1 is no longer free to rotate to find the correct circumferential velocity. This condition can be achieved by disconnecting actuator 27 at the moment that plate 25 touches container 1, or by programming a velocity profile in actuator 27 to match the traverse speed imparted by plate cylinder 22. As in FIG. 5, a section 29 of "dummy plate" may be left to engage container 1 before printing starts and to push it past plate cylinder 22 at the end of the printed area. It is desirable, but not mandatory, not to ink this "dummy" section as it comes into contact with chuck 16.

To print the other side of an oval container, a second print station may be used, or container 1 may be raised and rotated 180 degrees within one print cycle. The latter option requires the use of a more complex guide plate 26.

A more complex case arises when the container is tapered, or both tapered and oval. In such a case, it is best to use a tapered plate cylinder (not shown) that matches the taper of the container. Such a tapered plate cylinder will have some slippage relative to anilox roll 21, but such slippage is not detrimental to image quality. On the other hand, any slippage of printing plate 25 relative to the container will ruin the printed image. In the most generic case, each of arms 7A and 7B should have its own actuator 27 rather than a coupling shaft 28. This allows handling of containers with a high degree of taper or taper and ovality, as each end of the container can be moved at a different speed to maintain line contact with the plate 25.

The embodiments described above use mainly mechanical means to bring containers into registration with the plate. It is well known that any mechanical linkage such as a gear, lever, clutch or the like can be replaced by an electronic linkage performing the same function. Many modern flexographic presses no longer use gears to synchronize the cylinders; instead, they rely on electronic servo systems. Such presses are described by the general term "shaftless". It is considered to be obvious to one skilled in the art that the mechanical components in the above-described embodiments can be replaced with their electronic equivalents (or any other equivalent system, such as hydraulic). It is also clear that all the functions that are shown as purely mechanical in the embodiments described here can be performed with servo systems; thus items such as guide plates, detents, friction drive and the like can all be implemented using servo systems if so desired.

The current description should therefore be read in the broadest sense. For example, when a mechanical actuator such as a lever is shown, it is considered to be obvious that the lever can be replaced by an electrical actuator such as a solenoid or a motor or by a hydraulic cylinder. Similarly, while an endless belt type conveyor system is shown here to bring the carriers to the press, any other method of moving the carriers between the print units can be utilized. Examples of some well-known alternate techniques for moving carriers between print units include:

1. robotic arms to transport carriers between print units;
2. a rigid arrangement of carriers at the periphery of a large wheel; and
3. carriers linked together to form a linked belt (similar to a bicycle chain).

There have thus been outlined the important features of the invention in order that it may be better understood, and in order that the present contribution to the art may be better appreciated. Those skilled in the art will appreciate that the conception on which this disclosure is based may readily be utilized as a basis for the design of other methods and apparatus for carrying out the several purposes of the invention. It is most important, therefore, that this disclosure be regarded as including such equivalent methods and apparatus as do not depart from the spirit and scope of the invention.

What is claimed is:

1. A flexographic printing press for printing on a container, the press comprising:

at least one flexographic printing unit;

a carrier for engaging the container at at least one end thereof;

a translation mechanism coupled to the carrier for creating relative movement between the container and the at least one flexographic printing unit;

wherein the at least one flexographic printing unit comprises:

a plate support surface for supporting an image bearing flexographic printing plate and means for applying ink to the flexographic printing plate;

a sensor connected to detect a desired registration configuration when the flexographic printing plate is oriented at a desired position relative to the container; and an actuator mechanism for engaging the carrier to move a surface of the container into contact with the flexographic printing plate when the sensor detects the desired registration configuration.

2. A printing press according to claim 1 wherein the plate support surface is a circumferential surface of a plate cylinder that is rotatable about its longitudinal axis.

3. A printing press according to claim 2 wherein the sensor comprises an encoder coupled to detect an angular position of the plate cylinder about its longitudinal axis and wherein the desired registration configuration comprises a desired angular position of the plate cylinder about its longitudinal axis.

4. A printing press according to claim 3 wherein the carrier comprises a pivot joint for allowing pivotal movement of the container relative to the carrier.

5. A printing press according to claim 4 wherein contact between the container and the flexographic printing plate causes frictional torque which tends to actuate the pivot joint.

6. A printing press according to claim 5 wherein the carrier comprises a locking mechanism for preventing actuation of the pivot joint.

7. A printing press according to claim 5 wherein the translation mechanism comprises a conveyor belt.

8. A printing press according to claim 7 wherein the carrier is slidably coupled to the conveyor belt for allowing limited movement of the carrier relative to the conveyor belt.

9. A printing press according to claim 7 wherein the carrier is elastically coupled to the conveyor belt for allowing limited movement of the carrier relative to the conveyor belt.

10. A printing press according to claim 5 wherein the carrier comprises a chuck shaped to engage a first end of the container and a plug shaped to fit in an opening at a second end of the container.

11. A printing press according to claim 10 wherein the carrier comprises one or more springs for applying pressure to at least one of: the first end of the container and the second end of the container.

12. A printing press according to claim 10 wherein the plug comprises a conduit for injecting pressurized air into an interior of the container via the opening at the second end of the container.

13. A printing press according to claim 5 wherein the actuator mechanism comprises first and second arms for engaging the carrier on first and second ends of the container.

14. A printing press according to claim 13 wherein the actuator mechanism comprises an actuator coupled to move the first and second arms in unison.

15. A printing press according to claim 13 wherein the actuator mechanism comprises first and second actuators respectively coupled to the first and second arms for independent movement of the first and second arms.

16. A printing press according to claim 5 wherein the flexographic printing plate comprises a printable region and a friction providing region, the printable region having a length that is less than a circumference of the container and the friction providing region having a length that is at least as long as the circumference of the container for creating the frictional torque which tends to actuate the pivot joint.

17. A printing press according to claim 4 wherein the carrier comprises a registration mechanism for determining when the pivot joint has made a full rotation.

18. A printing press according to claim 17 wherein the registration mechanism comprises a detent mechanism for preventing further actuation of the pivot joint when it is determined that the pivot joint has made a full rotation.

19. A printing press according to claim 1 wherein a cross-section of the container is non-circular.

20. A printing press according to claim 19 wherein the plate support surface is a circumferential surface of a plate cylinder that is rotatable about its longitudinal axis.

21. A printing press according to claim 20 wherein the sensor comprises an encoder coupled to detect an angular position of the plate cylinder about its longitudinal axis and wherein the desired registration configuration comprises a desired angular position of the plate cylinder about its longitudinal axis.

22. A printing press according to claim 21 wherein the carrier comprises a pivot joint for allowing pivotal movement of the container relative to the carrier.

23. A printing press according to claim 22 wherein the carrier comprises a locking mechanism for preventing actuation of the pivot joint.

24. A printing press according to claim 1 wherein the container is tapered such that a radius of the container in a first region is greater than a radius of the container in a second region.

25. A printing press according to claim 24 wherein the plate support surface is a circumferential surface of a plate cylinder that is rotatable about its longitudinal axis and wherein the plate cylinder has a taper complementary to that of the container.

26. A printing press according to claim 25 wherein the sensor comprises an encoder coupled to detect an angular position of the plate cylinder about its longitudinal axis and wherein the desired registration configuration comprises a desired angular position of the plate cylinder about its longitudinal axis.

27. A printing press according to claim 26 wherein the carrier comprises a pivot joint for allowing pivotal movement of the container relative to the carrier.

28. A printing press according to claim 27 wherein contact between the container and the flexographic printing plate causes frictional torque which tends to actuate the pivot joint.

29. A printing press according to claim 1 wherein a cross-section of the container is non-circular and wherein the container is tapered such that a cross-sectional dimension of the container in a first region is greater than the cross-sectional dimension of the container in a second region.

30. A flexographic printing press for printing on a container, the press comprising:

at least one flexographic printing unit;

means for creating relative movement between the container and the at least one printing unit;

wherein the at least one flexographic printing unit comprises:

a plate support surface for supporting an image bearing flexographic printing plate and means for applying ink to the flexographic printing plate;

means for detecting a desired registration configuration wherein the flexographic printing plate is oriented at a desired position relative to the container; and means for moving a surface of the container into contact with the flexographic printing plate in response to detecting the desired registration configuration.

31. A printing press according to claim 30 wherein a cross-section of the container is non-circular.

32. A printing press according to claim 30 wherein the container is tapered such that a cross-sectional dimension of the container in a first region is greater than a cross-sectional dimension of the container in a second region.

33. A printing press according to claim 30 wherein a cross-section of the container is non-circular and the container is tapered such that a cross-sectional dimension of the container in a first region is greater than the cross-sectional dimension of the container in a second region and wherein the plate cylinder has a taper complementary to that of the container.

* * * * *